US006685888B1

(12) United States Patent
Shibata et al.

(10) Patent No.: US 6,685,888 B1
(45) Date of Patent: Feb. 3, 2004

(54) MONOLITH SUPPORTING STRUCTURE FOR USE IN CATALYTIC CONVERTER

(75) Inventors: Katsuhiro Shibata, Tokyo (JP); Ken Oouchi, Yokohama (JP); Hidetoshi Itou, Yokohama (JP); Kimiyoshi Nishizawa, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/527,466

(22) Filed: Mar. 17, 2000

(30) Foreign Application Priority Data

Mar. 18, 1999 (JP) ..... 11-073465

(51) Int. Cl.[7] ..... B01D 53/34; F01N 3/28; F01N 7/14

(52) U.S. Cl. ..... 422/179; 422/177; 422/180

(58) Field of Search ..... 422/171, 177, 422/179, 180

(56) References Cited

U.S. PATENT DOCUMENTS 4,142,864 A 3/1979 Rosynsky et al. ..... 422/179
4,347,219 A * 8/1982 Noritake et al. ..... 422/180
4,396,664 A 8/1983 Mochida et al. ..... 428/116
4,397,817 A 8/1983 Otani et al. ..... 422/179
5,555,621 A * 9/1996 Tanabe et al. ..... 422/179
5,656,245 A 8/1997 Fujisawa et al. ..... 422/179

FOREIGN PATENT DOCUMENTS

JP 7-317537 12/1995

* cited by examiner

*Primary Examiner*—Hien Tran
(74) *Attorney, Agent, or Firm*—Foley & Lardner

(57) ABSTRACT

For resiliently and safely supporting a monolith in a housing, a supporting structure is proposed. An annular seat structure is defined in the housing. An annular resilient washer is made of wire mesh and is put on the annular seat structure for supporting thereon a circular peripheral edge of the monolith. A biasing structure biases the monolith toward the annular resilient washer to compress the washer. The washer has a generally rectangular cross section and has a chamfered surface around a circular outer surface thereof. The chamfered surface is positioned radially outside the circular peripheral edge of the monolith. With this, even when compressed by the monolith, the washer is prevented from producing a biasing force for pulling the circular peripheral edge of the monolith radially outward, and thus, damage of the edge is suppressed.

8 Claims, 7 Drawing Sheets

OD>0

OD=0

OD<0

MONOLITH SUPPORTING STRUCTURE FOR USE IN CATALYTIC CONVERTER

BACKGROUND OF THE INVENTION

1. Field of the Invention

The present invention relates in general to catalytic converters of a type having a catalyst-coated honeycomb grid, called a monolith, in the housing of the converter, and more particularly to structures for safely supporting the monolith in the housing. More specifically, the present invention is concerned with holders by which the monolith is resiliently and safely held in the housing.

2. Description of the Prior Art

In recent cars, a catalytic converter is installed in an exhaust system of the engine to reduce exhaust emissions. Usually, the converter has a heat-resistant metal housing in which a catalyst-coated honeycomb grid, called monolith, is held through resilient holders or the like.

One of such conventional catalytic converters is shown in Japanese Patent First Provisional Publication 7-317537, which uses wire mesh members as the resilient holders. That is, in the converter, a cylindrical structure made of wire mesh is installed between the monolith and housing to resiliently hold the monolith in a radial direction, and two annular washers made of wire mesh are disposed on front and rear ends of the monolith to resiliently hold the monolith in an axial direction. However, due to fragility inevitably possessed by the monolith, particularly by circular peripheral edges of the monolith, safety holding of the same in the housing has been very difficult even when the above-mentioned resilient holders are practically used.

SUMMARY OF THE INVENTION

It is therefore an object of the present invention to provide a monolith supporting structure for resiliently and safely supporting a monolith in a housing of the converter.

According to a first aspect of the present invention, there is provided a monolith supporting structure for use in a catalytic converter having a monolith held in a housing. The structure comprises an annular seat structure defined by the housing; and an annular resilient washer made of wire mesh, the washer being put on the annular seat structure for supporting thereon a circular peripheral edge of the monolith. The washer has a generally rectangular cross section and has a chamfered surface around a circular outer surface thereof. The chamfered surface is positioned radially outside the circular peripheral edge of the monolith.

According to a second aspect of the present invention, there is provided a monolith supporting structure for use in a catalytic converter having a monolith held in a housing. In this structure, the washer has a first surface put on the annular seat structure and a second surface for directly supporting thereon the circular peripheral edge of the monolith, and the washer has a generally rectangular cross section and has a chamfered surface around a circular inner surface thereof, so that a width of the second surface of the annular resilient washer is smaller than that of the first surface of the washer.

According to a third aspect of the present invention, there is provided a monolith supporting structure for use in a catalytic converter having a monolith held in a housing. In this structure, the washer comprises an outer portion located radially outside the circular peripheral edge of the monolith and an inner portion located radially inside the circular peripheral edge, and the outer portion of the washer produces no swelled portion, that would surround the circular peripheral edge, even when compressed by the monolith.

According to a fourth aspect of the present invention, there is provided a monolith supporting structure for use in a catalytic converter having a monolith held in a housing. In this structure, the washer has a generally rectangular cross section and has first and second chamfered surfaces around circular outer and inner surfaces thereof, so that a width of the second surface of the annular resilient washer is smaller than that of the first surface of the washer.

DETAILED DESCRIPTION OF THE INVENTION

In the following, the present invention will be described in detail with reference to accompanying drawings.

For ease of understanding, directional terms, such as, upper, lower, right, left, upward etc., are used in the description. However, it is to be noted that such terms are to be understood with respect to only drawing or drawings on which the corresponding parts or portions are illustrated.

Figure 1:
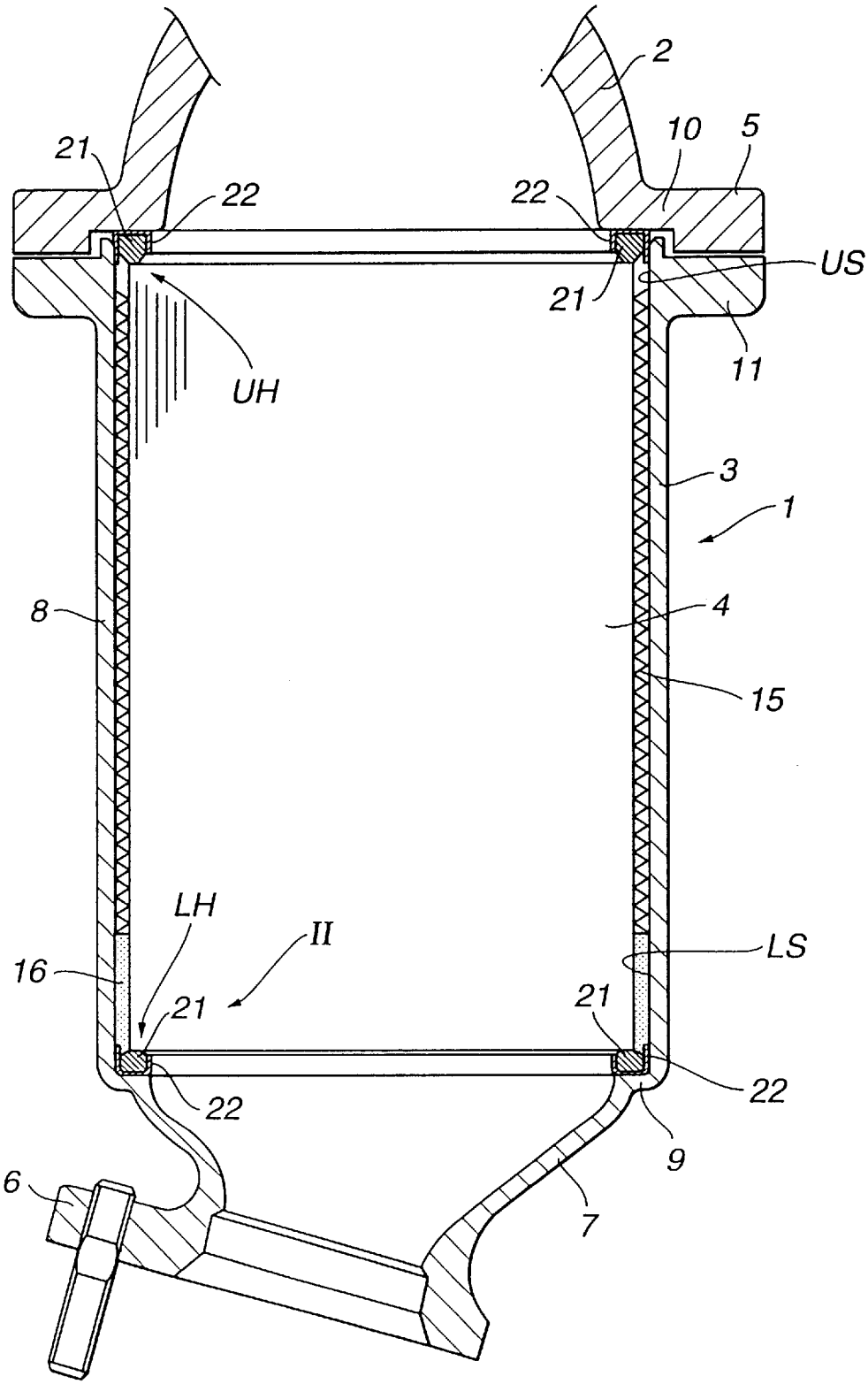
FIG. 1 is a sectional view of a catalytic converter to which a monolith supporting structure of the present invention is practically applied.

Referring to FIG. 1, there is shown in section a catalytic converter 1 to which the present invention is practically applied. The catalytic converter 1 shown is connected to an outlet port of an exhaust manifold 2 of an internal combustion engine mounted on a motor vehicle.

Within a casing constituted by an annular flange 5 provided around the outlet port of the exhaust manifold 2 and a cylindrical container 3 of the catalytic converter 1, there is installed a cylindrical monolith 4 that is made of a ceramic. Usually, the thickness of cell wall of the monolith 4 is about several mils, and thus, the monolith 4 is fragile. In fact, even a cylindrical wall, viz., the outermost layer of the monolith 4 has a thickness only several times as long as the cell wall. The cylindrical container 3 has at its upper portion an annular flange 11 which is secured to the annular flange 5 through bolts (not shown).

As shown, the cylindrical container 3 comprises a cylindrical major portion 8 which contains therein the monolith 4 and a cone-shaped outlet portion 7 which has a flange 6 at the leading end thereof. Although not shown in the drawing, a front end of an exhaust tube is connected to the flange 6 through bolts to communicate the interior of the container 3 with that of the exhaust tube.

As is well seen from FIG. 1, the inner wall of the container 3 is formed, at a junction portion between the cylindrical major portion 8 and the cone-shaped outlet portion 7, with an annular step 9 for holding a lower peripheral edge of the cylindrical monolith 4 through an after-mentioned lower holder "LH". Similar to this, the inner wall of the flange 5 of the exhaust manifold 2 is formed, at a portion facing the interior of the cylindrical major portion 8, with an annular step 10 for holding a upper peripheral edge of the cylindrical monolith 4 through an after-mentioned upper holder "UH".

The internal diameter of the container 3 is slightly larger than the outer diameter of the cylindrical monolith 4, so that there is defined therebetween a cylindrical space.

Within this cylindrical space, there is interposed a cylindrical cushioning supporter 15 by which the cylindrical monolith 4 is resiliently held in a radial direction. The cushioning supporter 15 is of a cylindrical mat made of a corrugated wire mesh.

As is seen from FIG. 1, the axial length of the cushioning supporter 15 is smaller than that of the monolith 4, so that there are defined two cylindrical spaces "US" and "LS" around upper and lower portions of the monolith 4.

Within the lower cylindrical spaces "LS", there is disposed a cushioning mat 16 made of non-combustible fibers. The mat 16 is crammed in the space "LS" to achieve a sealing between the outer surface of the monolith 4 and the inner surface of the major portion 8 of the container 3. That is, with provision of the mat 16, flowing of exhaust gas through the cushioning supporter 15 is appropriately suppressed.

Since the lower and upper holders "LH" and "UH" are substantially the same in construction, detailed explanation on them will be directed to only the lower holder "LH".

Figure 2:
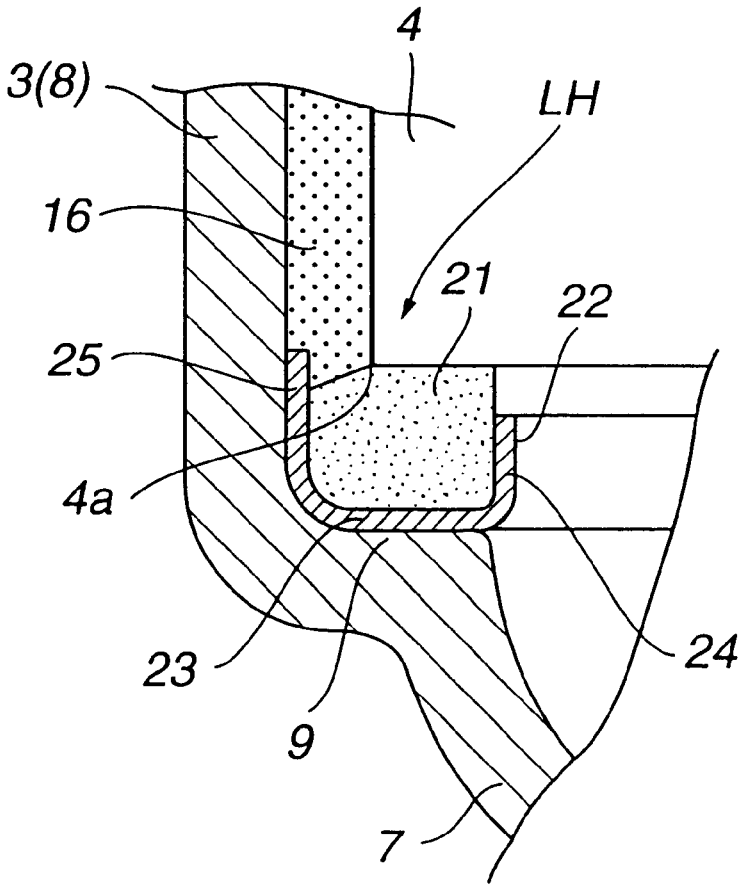
FIG. 2 is an enlarged view of the part indicated by an arrow "II" of FIG. 1.

As is seen from FIGS. 1 and 2, the lower holder "LH" comprises an annular resilient washer 21 and an annular metal 35 cap 22 on which the washer 21 is put. The cap 22 is made of a ferritic stainless steel having a very small thermal expansion, such as SUS430 (japanese Industrial Standard) or the like.

As is seen from FIG. 2, the cap 22 comprises an annular base wall 23, an inner cylindrical wall 24 raised from an inner periphery of the base wall 23 and an outer cylindrical wall 25 raised from an outer periphery of the base wall 23. Thus, the cap 22 has a generally U-shaped cross section.

As shown, upon assembly, the inner and outer cylindrical walls 24 and 25 of the cap 22 are positioned inside and outside an outer periphery 4*a* of the lower end of the cylindrical monolith 4 (viz., a lower peripheral edge 4*a* of the monolith 4), respectively. The outer cylindrical wall 25 thus partially laps the outer surface of the monolith 4. The height of the inner cylindrical wall 24 is smaller than that of the resilient washer 21, so that undesired abutment of the lower end of the monolith 4 against the top of the inner cylindrical wall 24 is prevented even if a marked stress is applied to the monolith 4 in a direction to compress the resilient washer 21 under cruising of an associated motor vehicle.

The resilient washer 21 is of an annular structure made of a braided wire mesh. More specifically, for producing the resilient washer 21, the braised wire mesh is pressed in pressing dies to have a given shape. As is seen from the drawings, the resilient washer 21 is concentrically put in the cap 22. Upon proper mounting in the container 3, the resilient washer 21 has radially outer portion positioned radially outside the lower peripheral edge 4*a* of the cylindrical monolith 4 and a radially inner portion positioned radially inside the lower peripheral edge 4*a* of the monolith 4.

As has been mentioned hereinabove, the upper holder "UH" is substantially the same in construction as the above-mentioned lower holder "LH". That is, as is seen from FIG. 1, the upper holder "UH" comprises an annular resilient washer 21 and an annular metal cap 22 in which the washer 21 is coaxially put. In the upper holder "UH" however, the annular base portion of the cap 22 contacts an annular flat wall (no numeral) defined by the annular step 10, and the resilient washer 21 resiliently holds and presses an upper peripheral edge of the cylindrical monolith 4, as shown.

As will be understood from FIG. 1, when the annular flange 11 of the cylindrical container 3 is properly secured to the annular flange 5 through bolts, the upper and lower holders "UH" and "LH" are resiliently compressed by a given degree.

Figure 3:
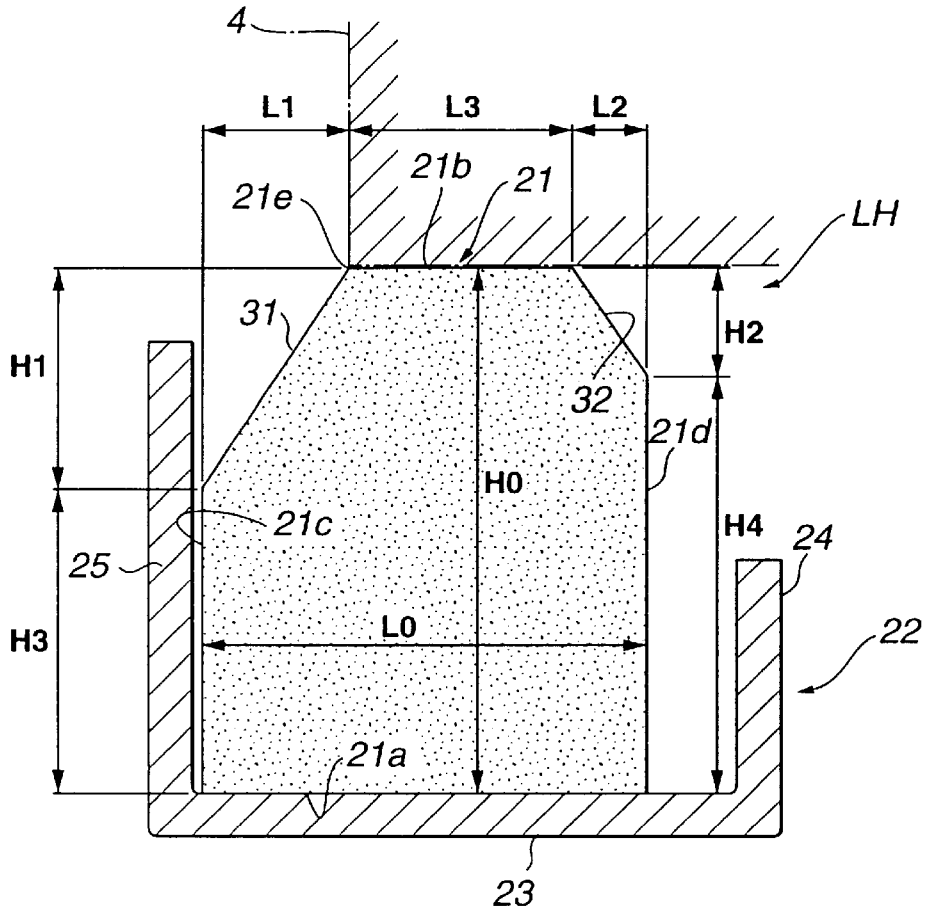
FIG. 3 is an enlarged sectional view of a resilient washer and a cap used in the present invention, showing a condition wherein no stress is applied to the resilient washer.

As will become apparent as the description proceeds, when the upper and lower holders "UH" and "LH" are compressed by the given degree at a normal temperature, each resilient washer 21 contacts the outer cylindrical wall 25 of the cap 22 while keeping a certain but small space between an inner cylindrical surface of the washer 21 and the inner cylindrical wall 24 of the cap 22, as will be understood from FIG. 3. That is, the space is provided for accommodating an expanded part of the cap 22 that appears when the cap 22 is heated under usage of the catalytic converter 1.

FIG. 3 shows a sectional view of the lower holder "LH" under a condition wherein no stress is applied thereto. As shown, under this non-stressed condition, the resilient washer 21 of the lower holder "LH" has a generally rectangular cross section, and is shaped to comprise a base surface 21*a*, a top surface 21*b*, an outer surface 21*c* and an inner surface 21*d*. Between the top surface 21*b* and the outer surface 21*c*, there is provided a first chamfered surface 31, and between the top surface 21*b* and the inner surface 21*d*, there is provided a second chamfered surface 32. It is to be noted that the first chamfered surface 31 is positioned outside of the lower peripheral edge 4*a* of the cylindrical monolith 4. More specifically, an outer periphery 21*e* of the top surface 21*b* is mated with the lower peripheral edge 4*a* of the monolith 4, as shown.

That is, under the non-stressed condition of the lower holder "LH", the following relationships are established at the same time:

$$L1>L2;\ L1<L3;\ H1>H2;\ H1<H3;\ L1[[\geq]]\leq H1;\ L2[[\geq]]\leq H2;\ L0<H0 \quad (1)$$

wherein:

L1: radial length of first chamfered surface 31,

L2: radial length of second chamfered surface 32,

L3: radial length of the top surface 21*b*,

H1: axial length of first chamfered surface 31,

H2: axial length of second chamfered surface 32,

H3: axial length of outer surface 21*c*,

L0: thickness of resilient washer 21,

H0: height of resilient washer 21.

In the illustrated embodiment, L0 is about 6 mm, L1 is about 2 mm, L2 is about 1 mm, L3 is about 3 mm, H0 is about 7.1 mm, H1 is about 3 mm, H2 is about 1.5 mm and H3 is about 4.1 mm, and the diameter of the wire for the wire mesh of the resilient washer 21 is not larger than 0.15 mm. The plate thickness of the cap 22 is about 0.6 mm.

Furthermore, under the non-stressed condition of the lower holder "LH", there is defined a clearance of about 0.1 mm between the outer cylindrical wall 25 of the cap 22 and the outer surface 21*c* of the washer 21, and there is defined a clearance of about 1.2 mm between the inner cylindrical wall 24 of the cap 22 and the inner surface 21*d* of the washer 21.

It is now to be noted that the upper holder "UH" has substantially the same dimensional relation as that possessed by the lower holder "LH".

When, as is seen from FIG. 1, the cylindrical monolith 4 is properly installed in the cylindrical housing 3, the lower and upper holders "LH" and "UH" are pressed in the axial direction as has been mentioned hereinabove. Thus, the resilient washer 21 of each holder "LH" or "UH" is compressed by a certain degree, thereby resiliently holding the monolith 4 in the housing 3. In the illustrated embodiment, the resilient washer 21 is subjected to a compression of about 50% or less. That is, due to the compression, the height of the resilient washer 21 is reduced to about 4.3 mm. With this, an upper tapered portion of the resilient washer 21 (see FIG. 3), that is defined by the top surface 21*b* and first and second chamfered surfaces 31 and 32, is mainly compressed.

It is to be noted that this type of compression brings about a smoothed axial force application to the lower peripheral edge 4*a* of the cylindrical monolith 4. It is further to be noted that due to provision of the first chamfered surface 31, even when compressed, the lower resilient washers 21 is prevented from forming a swelled part that would be lapped around the lower peripheral edge 4*a* of the monolith 4. Furthermore, due to provision of the second chamfered surface 32, even when the resilient washer 21 is compressed, there is produced no biasing force that would bias the peripheral edge 4*a* of the monolith 4 radially outward. Furthermore, due to provision of the space between the inner cylindrical wall 24 of the cap 22 and the inner surface 21*d* of the resilient washer 21, a radially outward shifting of the wall 24 due to a thermal expansion of the cap 22 does not bias the washer 21 radially outward. It is to be noted that these phenomena are also expected from the upper holder "UH".

With these advantageous phenomena provided by the unique arrangement of the present invention, the lower and upper peripheral edges 4*a* of the cylindrical monolith 4 are assuredly protected from damage.

If desired, the following relationships may be used in the present invention.

$$L1>L2;\ L1<L3;\ H1>H2;\ H1<H3;\ L1\leq H1;\ L1\leq H2;\ L0\geq H0 \quad (2)$$

Figure 4:
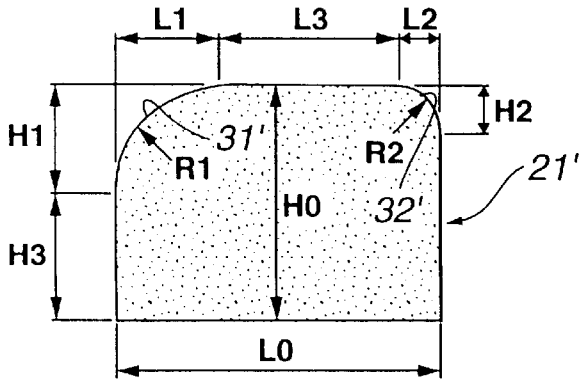
FIG. 4 is an enlarged sectional view of a modification of the resilient washer, which is usable in the present invention.

FIG. 4 shows a modification 21' of the resilient washer 21. In this modification 21', the first and second chamfered surfaces 31' and 32' are shaped convex, each having a radius of curvature "R1" or "R2". Preferably, the radius "R1" is larger than the radius "R2".

In order to establish the present invention, various tests have been carried out by the inventors, which will be described in the following.

Figure 5A:
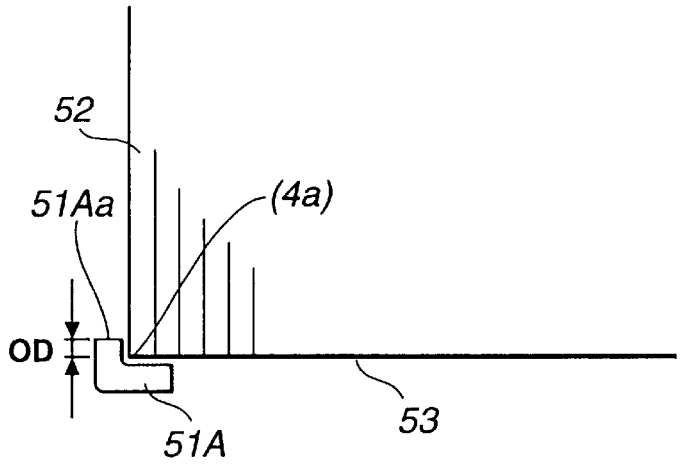
FIGS. 5A, 5B and 5C are illustrations showing compressed conditions of various resilient washers, which are assumed when a monolith is supported by the resilient washers.
Figure 5B:
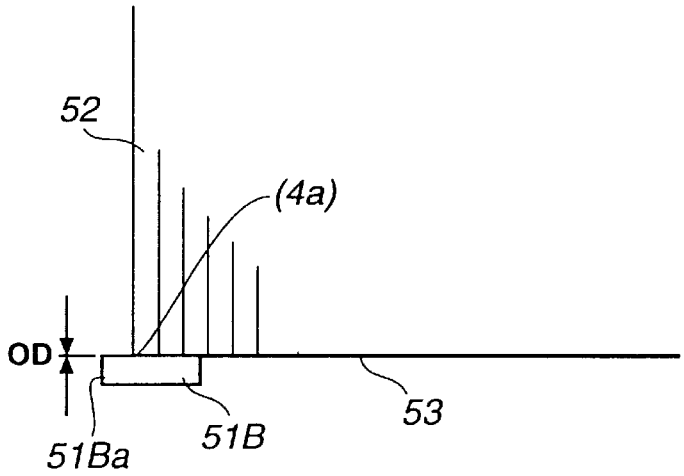
Figure 5C:
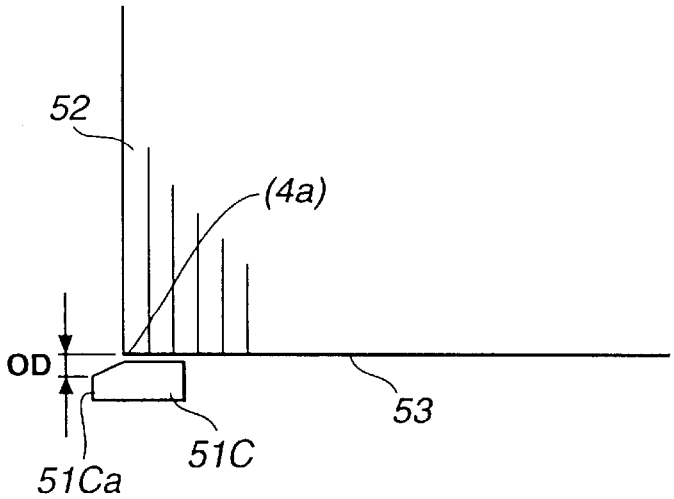

FIGS. 5A, 5B and 5C show results of one test applied to three, viz., first, second and third resilient washers 51A, 51B and 51C. The third washer 51C had a chamfered surface corresponding to the above-mentioned first chamfered surface 31 (see FIG. 3) employed in the present invention.

In the test, each resilient washer 51A, 51B or 51C was compressed by the lower peripheral edge 53 of the monolith 52 by such a degree as to appropriately support the monolith 52. As shown, in the first washer 51A of FIG. 5A, there was produced an upwardly swelled up part 51A*a* that surrounded the lower peripheral edge 53 of the monolith 52, and in the second and third washers 51B and 51C of FIGS. 5B and 5C, there was produced no part that was swelled up. For ease of understanding, the non-swelled up parts of the second and third washers 51B and 51C are denoted by references 51B*a* and 51C*a*.

Thus, if a distance between the top of the swelled up (or non-swelled up) part 51A*a*, 51B*a* or 51C*a* of the washer 51A, 51B or 51C and the lower peripheral edge 53 of the monolith 52 is represented by Overlapped Degree "OD", the following inequality is given to each washer 51A, 51B or 51C:

In the first resilient washer 51A:

$$OD>0 \quad (3)$$

In the second resilient washer 51B:

$$OD=0 \quad (4)$$

In the third resilient washer 51C:

$$OD<0 \quad (5)$$

For finding the correlation between the Overlapped Degree "OD" and a rate of damage occurrence at the lower peripheral edge 53 of the monolith 52, several tests were applied to the first, second and third resilient washers 51A, 51B and 51C.

Figure 6:
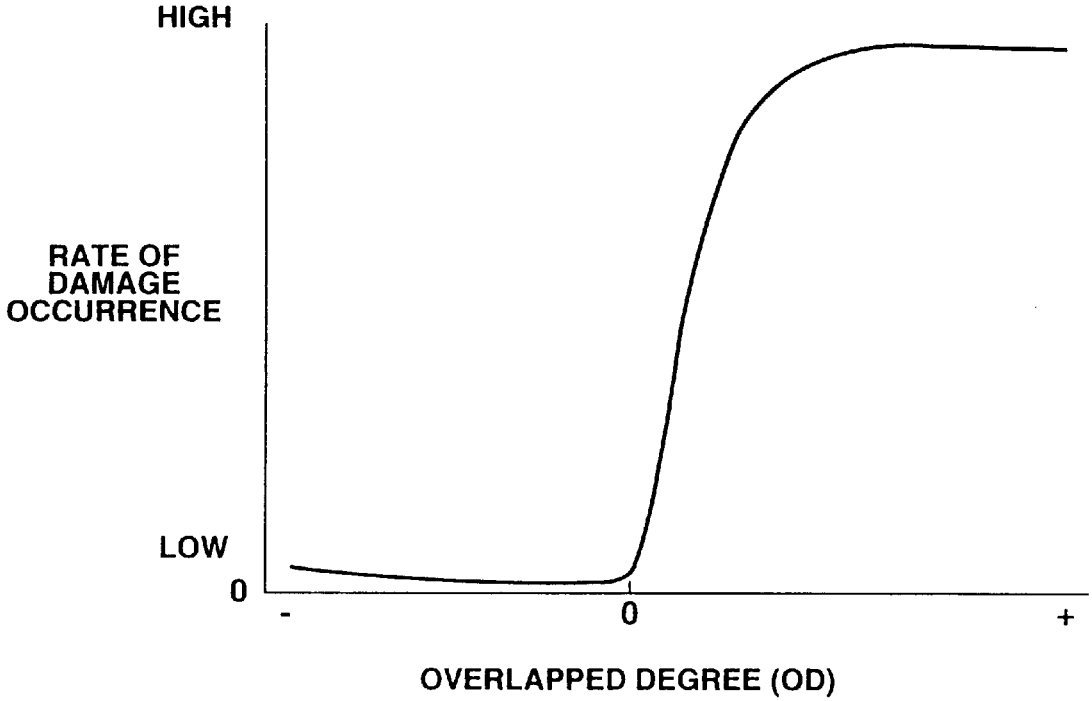
FIG. 6 is a graph showing a rate of damage occurrence with respect to an overlapped degree.

FIG. 6 is a graph showing the results of the tests. As is seen from this graph, when the Overlapped Degree "OD" exceeds 0 (zero), the rate of damage occurrence becomes very high.

The inventors have revealed that, as will be seen from FIG. 5A, such high damage rate is caused by an outwardly biasing force that would be produced under the lower peripheral edge 53 of the monolith 52 when the first resilient washer 51A is compressed to such a degree as to produce the upwardly swelled up part 51A*a*. That is, the outwardly biasing force pulls the lower peripheral edge 53 radially outward and thus damages the same. In case of the second and third resilient washers 51B and 51C, there is produced no force corresponding to such outwardly biasing force.

Figure 7A:
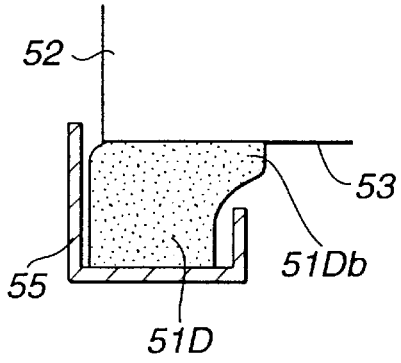
FIGS. 7A and 7B are illustrations showing the manner of a resilient washer assumed when the washer is kept in relatively lower temperature and high temperature respectively, the resilient washer having no part corresponding to a second chamfered surface.
Figure 8A:
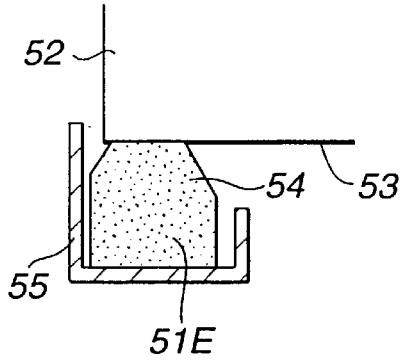
FIGS. 8A and 8B are illustrations showing the manner of another resilient washer assumed when the washer is kept in relatively low temperature and high temperature respectively, the washer having a part corresponding to the second chamfered surface.
Figure 7B:
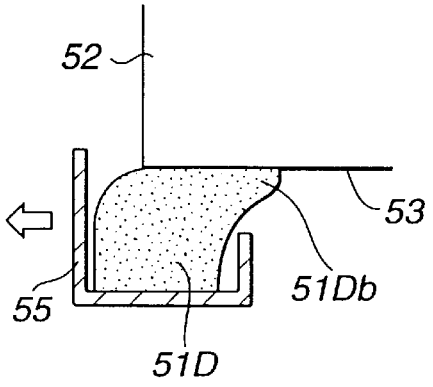
Figure 8B:
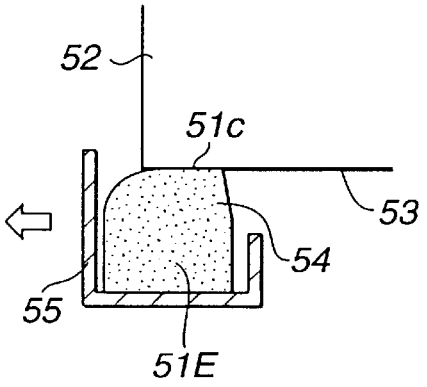

FIGS. 7A, 7B, 8A and 8B are illustrations showing the results of another test, that is, the manner of other two, viz., fourth and fifth resilient washers 51D and 51E taken when they were kept at relatively low temperature and high temperature respectively. Each washer 51D or 51E was put on a cap 55. FIGS. 7A and 8A show the relatively low temperature condition and FIGS. 7B and 8B show the high temperature condition. The fourth resilient washer 51D had no part corresponding to the above-mentioned second chamfered surface 32, while, the fifth resilient washer 51E had a part 54 corresponding to the second chamfered surface 32. The fourth resilient washer 51D practically used had an inwardly projected portion denoted by 51D*b*.

As will be seen from FIGS. 7A and 7B, when heated, the cap 55 is expanded and thus moved radially outward. With this, the relatively large top area of the fourth resilient washer 51D pulls the lower peripheral edge 53 radially outward inducing a possibility of damaging the same. While, as is seen from FIGS. 8A and 8B, in case of the fifth resilient washer 51E, even when the cap 55 is moved radially outward due to its thermal expansion, the relatively small top area of the washer 51E fails to strongly pull the peripheral lower edge 53 radially outward. This is because of a less frictional resistance produced between the relatively small top area of the washer 51E and the lower peripheral edge 53. Thus, in case of the fifth washer 51E, the possibility of damaging the edge 53 becomes quite low.

For finding the correlation between an out-of-centering between the lower and upper surfaces of the resilient washer 51 and the rate of damage occurrence of the monolith 52, many tests were carried out.

Figure 9:
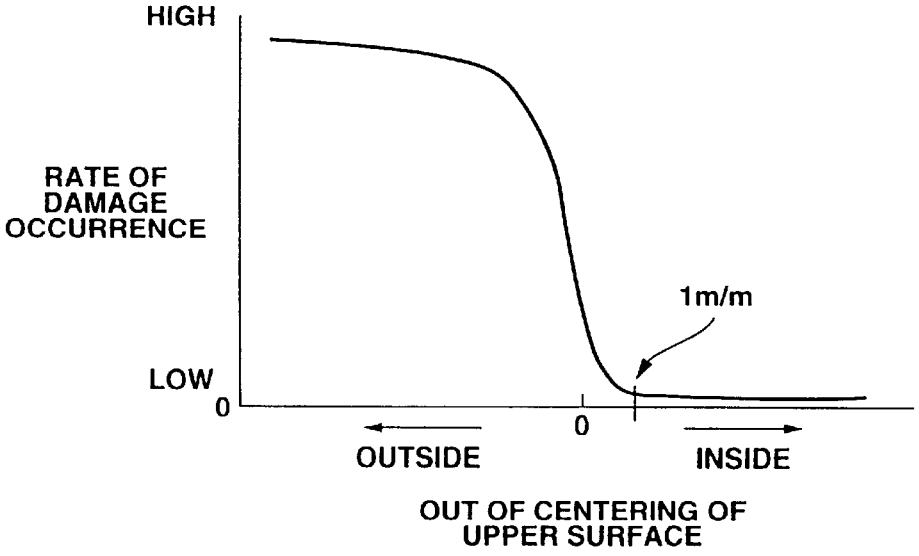
FIG. 9 is a graph showing a correlation between an out-of-centering of the upper surface of a resilient washer to the lower surface and a rate of damage occurrence of a monolith.

FIG. 9 is a graph showing the results of the tests. As is understood from this graph, when the center position of the upper surface is positioned radially outside the center position of the lower surface, the rate of damage occurrence becomes very high. However, when the center position of the upper surface is positioned inside the center position of the lower surface, the rate of damage occurrence is quite low. The tests have revealed that only 1 mm inside displacement of the center position of the upper surface induces a desired result.

Figure 10:
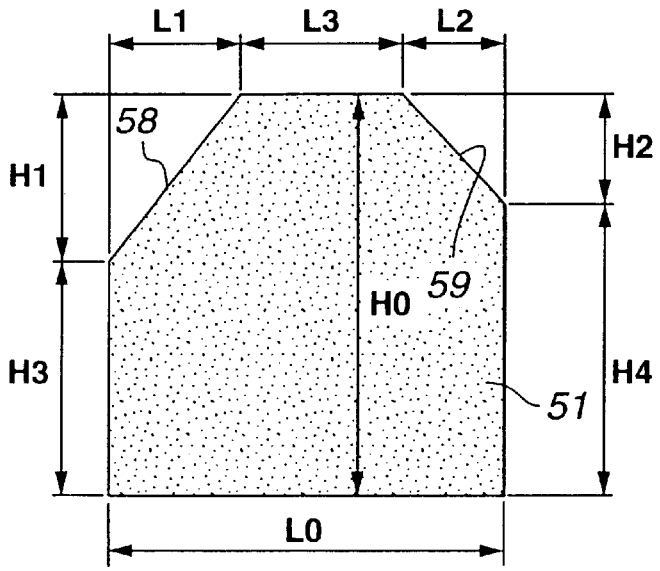
FIG. 10 is a sectional view of a resilient washer having a most preferable shape.

FIG. 10 shows a sectional view of a preferable resilient washer 51. The washer 51 has outside and inside chamfered surfaces 58 and 59 that correspond to the above-mentioned first and second chamfered surfaces 31 and 32. It is to be noted that when "L1>L2 " is established as shown in the drawing, the center position of the upper surface is positioned inside the center position of the lower surface. It is to be noted that the area denoted by L3 is the upper surface that directly and resiliently supports the lower peripheral edge of the monolith.

For finding the correlation between the width L3 of the upper surface and the rate of damage occurrence, several tests were carried out.

Figure 11:
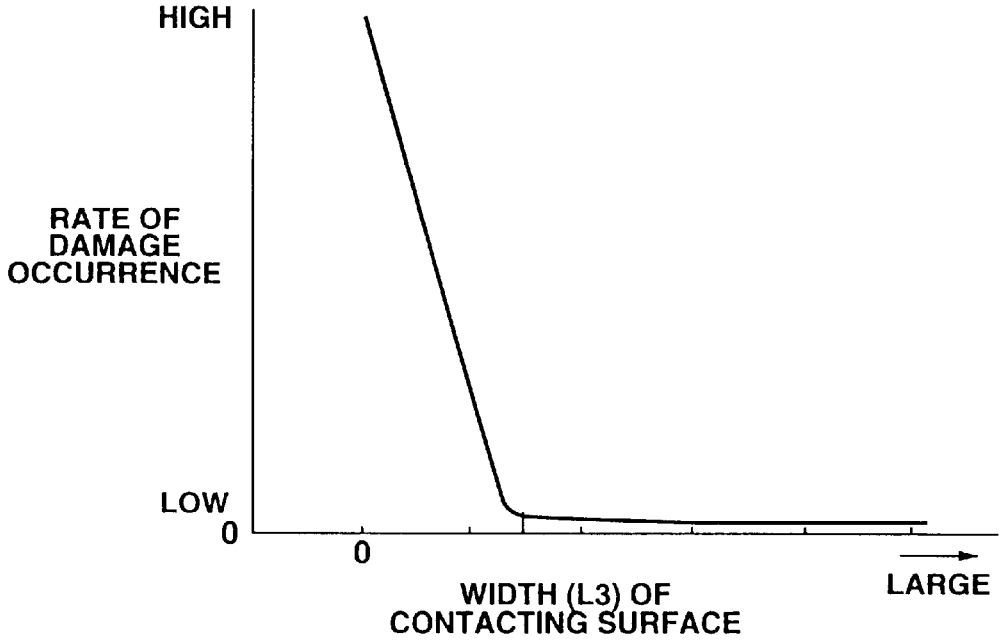
FIG. 11 is a graph showing a rate of damage occurrence with respect to the width of a contacting surface of a resilient washer.

FIG. 11 is a graph showing the results of the tests. As is seen from this graph, when the width L3 is smaller than a given degree (for example 3 mm), the rate of damage occurrence becomes very high.

The entire contents of Japanese Patent Application P11-73465 (filed Mar. 18, 1999) are incorporated herein by reference.

Although the invention has been described above with reference to a certain embodiment of the invention, the invention is not limited to the embodiment described above. Various modifications and variations of the embodiment described above will occur to those skilled in the art, in light of the above teachings.

What is claimed is:

1. In a catalytic converter having a monolith held in a housing, a monolith supporting structure for resiliently holding said monolith in said housing, comprising:

an annular seat structure defined by said housing; and an annular resilient washer made of wire mesh, said washer being put on said annular seat structure for supporting thereon a circular peripheral edge of said monolith;

wherein said annular resilient washer has a generally rectangular cross section and has a chamfered surface around a circular outer surface thereof, said annular resilient washer having a top surface for directly supporting thereon said circular peripheral edge of said monolith, said chamfered surface being positioned radially outside the circular peripheral edge of said monolith when said annular resilient washer is compressed by said monolith by a certain degree.

2. A monolith supporting structure as claimed in claim 1, further comprising a cap for putting therein said washer, said cap including an annular base wall, an inner cylindrical wall raised from an inner periphery of the base wall and an outer cylindrical wall raised from an outer periphery of the base wall, said wall outer cylindrical wall being positioned radially outside the circular peripheral edge of the monolith and said inner cylindrical wall being positioned radially inside the circular peripheral edge of the monolith.

3. A monolith supporting structure as claimed in claim 1, in which the diameter of the wire of the wire mesh of the resilient washer is not larger than 0.15 mm.

4. A monolith supporting structure as claimed in claim 1, in which a thickness of cell wall of said monolith is approximately several mils.

5. In a catalytic converter having a monolith held in a housing, a monolith supporting structure for resiliently holding said monolith in said housing, comprising:

an annular seat structure defined by said housing; and an annular resilient washer made of wire mesh, said washer being put on said annular seat structure for supporting thereon a circular peripheral edge of said monolith, said washer having a first surface put on said annular seat structure and a second surface for directly supporting thereon said circular peripheral edge of said monolith;

wherein said annular resilient washer has a generally rectangular cross section and has a chamfered surface around a circular inner surface thereof, so that a width of said second surface of said annular resilient washer is smaller than that of said first surface of the washer, said chamfered surface being positioned radially inside the circular peripheral edge of said monolith when said annular resilient washer is compressed by said monolith by a certain degree.

6. In a catalytic converter having a monolith held in a housing, a monolith supporting structure for resiliently holding said monolith in said housing, comprising:

an annular seat structure defined by said housing; and an annular resilient washer made of wire mesh, said washer being put on said annular seat structure for supporting thereon a circular peripheral edge of said monolith, said washer having a first surface put on said annular seat structure and a second surface for directly supporting thereon said circular peripheral edge of said monolith;

wherein said annular resilient washer has a generally rectangular cross section and has first and second chamfered surfaces around circular outer and inner surfaces thereof, so that a width of said second surface of said annular resilient washer is smaller than that of said first surface of the washer, said first and second chamfered surfaces being positioned radially outside and inside the circular peripheral edge of said monolith respectively when said annular resilient washer is compressed by said monolith by a certain degree.

7. A monolith supporting structure as claimed in claim 6, in which a center position of the second surface is positioned radially inside a center position of the first surface.

8. A monolith supporting structure as claimed in claim 6, in which said annular resilient washer is shaped to satisfy the following relations when no stress is applied thereto:

$$L1>L2;\ L1<L3;\ H1>H2;\ H1<H3;\ L0<H0.$$

wherein:

L1: radial length of the first chamfered surface,

L2: radial length of the second chamfered surface,

L3: radial length of the second surface,

H1: axial length of the first chamfered surface,

H2: axial length of the second chamfered surface,

H3: axial length of an outer cylindrical surface of the washer,

L0: thickness of the washer,

H0: height of the washer.

* * * * *